United States Patent [19]

Huang

[11] 4,454,735

[45] Jun. 19, 1984

[54] SCREW LOCK

[76] Inventor: Tsao K. Huang, 73-2, Yung Lo Alley, Shui LI Hsiang, I Feng Tsun, Nanto, Taiwan, 553

[21] Appl. No.: 272,790

[22] Filed: Jun. 11, 1981

Related U.S. Application Data

[63] Continuation-in-part of Ser. No. 146,373, May 2, 1980, abandoned.

[51] Int. Cl.[3] ..... E05B 15/06; E05B 19/02; E05B 19/06

[52] U.S. Cl. ..... 70/346; 70/407; 70/409; 70/412

[58] Field of Search ..... 70/344, 345, 346, 347, 70/362, 407, 409, 412

[56] References Cited

U.S. PATENT DOCUMENTS

| | | | |
|---|---|---|---|
| 63,230 | 3/1867 | Dickson | 70/407 |
| 616,751 | 12/1898 | Vedder et al. | 70/407 |
| 842,834 | 1/1907 | Hurdle | 70/407 |
| 1,804,955 | 5/1931 | Schlumpf | 70/407 |
| 1,932,706 | 10/1933 | Neer | 70/407 |
| 4,193,276 | 3/1980 | Lundberg | 70/409 |

*Primary Examiner*—Robert L. Wolfe

*Attorney, Agent, or Firm*—Cushman, Darby & Cushman

[57] ABSTRACT

This invention relates to a screw lock, characterized in that the screw key screws into a keyway, and the slots on the top ring screw of the screw key provide a convex-concave match with switch points in the cylinder. The screw key is then pushed in and turns the cylinder to effect locking and unlocking. The keyway of this invention is adapted to accept the spiral screw shape, and accordingly, the form and the mechanism of the switch points are not seen. Thus, the form and mechanism of the switch points in the cylinder is unknown. Also, conventional keys or wires cannot be inserted into the spiral screw hole. In case other keys are inserted into the keyway, the set points in the cylinder prevent the key form being further pushed in and prevent turning of the cylinder to effect unlocking.

5 Claims, 6 Drawing Figures

Fig. 2.
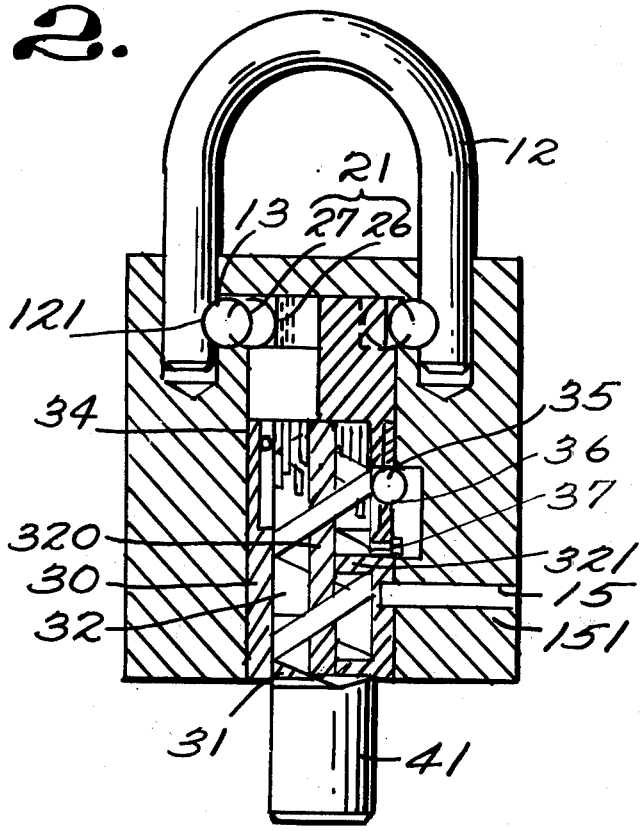
Fig. 5.
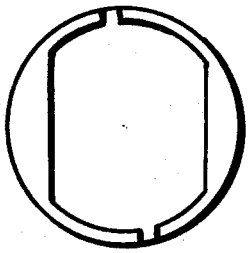
Fig. 3.
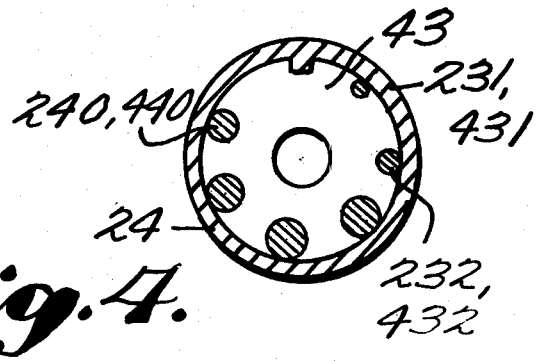
Fig. 4.

SCREW LOCK

BACKGROUND OF THE INVENTION

This application is a continuation in part of copending U.S. application Ser. No. 146,373, filed May 2, 1980 and now abandoned.

Traditional locks utilize a flat, straight keyway and contain a plurality of switch points. When a sawtoothed key is inserted into the keyway, the key's ward will contact the switch points and turn the entire cylinder bushing to effect unlocking. Accordingly, traditional locks are easily unlocked by a similar key or other thin wires or hooks inserted into the keyway. Since the keyway is in straight line form, the switch points are easily seen from the key hole, and as a result, the lock may be easily unlocked by a simple key or by directly destroying the switch points.

In addition, traditional locks use set springs to push the switch points upward. Such springs are typically very thin, thereby tending to stick when the lock is rushed or dirtied. In addition, the set openings are subject to elastic failure, thus reducing the lock's life.

Various traditional locks utilize sawtoothed switch points which match with the key's ward and the cylinder bushing to get the unlocking. However, such mechanisms are complicated assemblies and are difficult to manufacture. Moreover, the cost of manufacture increases as the precision of the lock assembly is increased. The traditional mechanism is similarly subject to unlocking by other similar keys or skeleton keys made by wires or steel pieces. Set springs are indispensable for such a traditional mechanism. Accordingly, if the springs are out of order, the lock will be consequently out of order. In this respect, the traditional locks have a high breakdown rate and provide less than desirable durability and security.

The primary object of this invention is to improve the above-noted problems often encountered with conventional locks. The present invention provides a screw shape (spiral) keyway which is not susceptible to entry by conventional or similar keys, wires or steel pieces. Thus, security against lock picking is improved.

The second object of this invention is to provide a lock which has the switch points installed in the screw keyway without set springs and with a mechanism that cannot be directly seen from the key hole. Thus, security is improved since the lock mechanism cannot be destroyed from outside. Similarly, elimination of the set springs increases the lock's dependability and reduces it breakdown rate.

BRIEF DESCRIPTION OF THE DRAWINGS

Preferred exemplary embodiments that will be described in conjunction with the appended drawing wherein like numerals denote like elements, and;

FIG. 2 is an assembly front view of the embodiment of FIG. 1;

FIG. 3 is an illustrative view of the match between the key and the wires of the switch points of this invention;

FIG. 4 is a view of the stop-turning ball in this invention;

FIG. 5 is a top view of the cylinder of this invention; and

DETAILED DESCRIPTION OF THE PREFERRED EMBODIMENT

Figure 1:
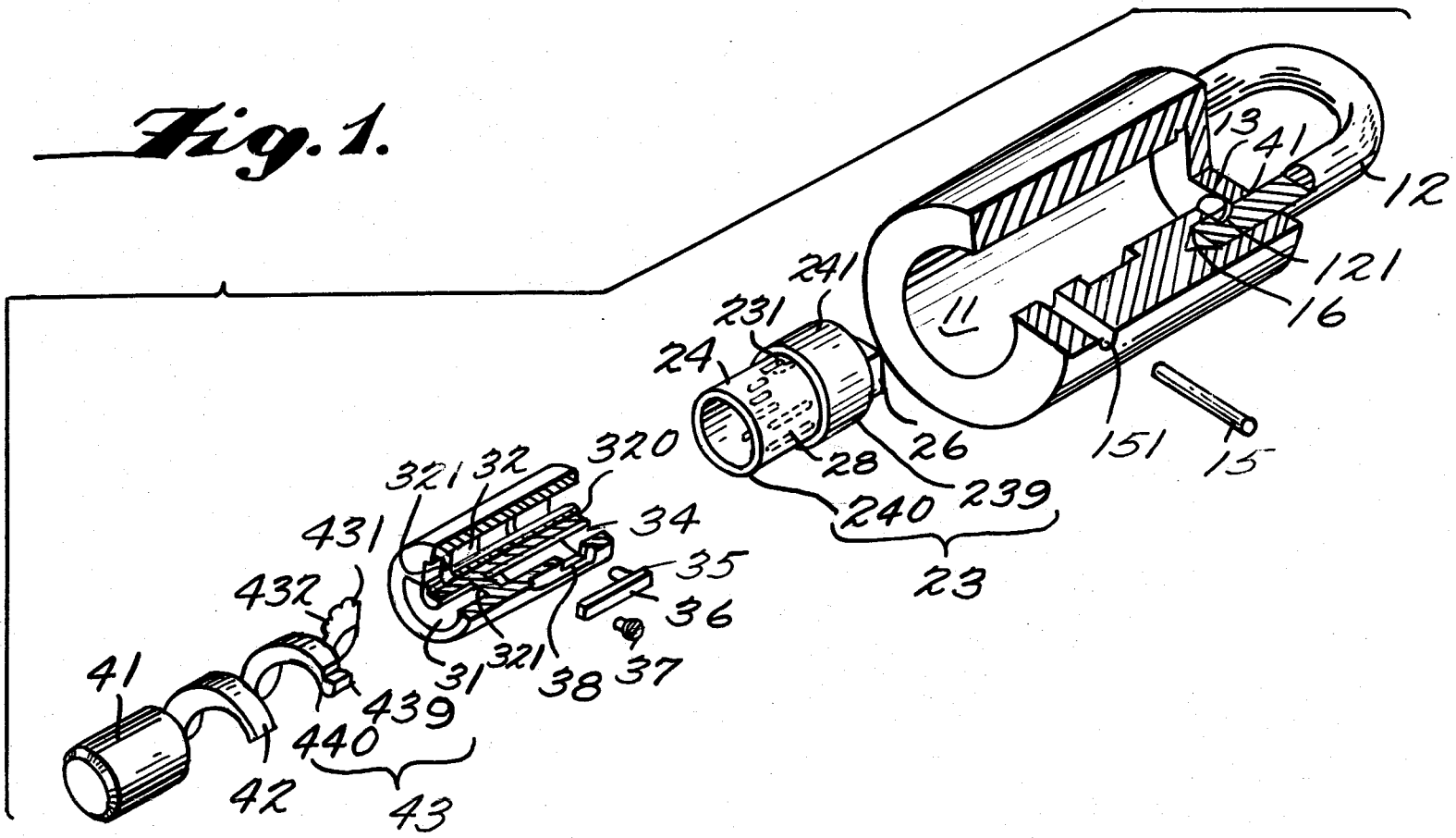
FIG. 1 is an assembly relief map of one embodiment of this invention.

Referring now to FIG. 1, there are shown in assembly relief map form one embodiment of a lock in accordance with the present invention, including a lock body 10, cylinder 20, cylinder bushing 30 and screw key 40. Screw key 40 has a handle end 41 to facilitate the hand operation (turning), and a spiral shaped screw member 42 having a plurality of slots 431–440 that are formed in the forward most turn (hereinafter referred to as the top ring screw 43) of the screw member 42.

The width and quantity of the slots 431–440 are equal to the diameters and the quantity of the switch points 23 in the cylinder 20. (In this practical example, 10 switch points are used, but each switch point has a diameter different from the others.) Slots 431–440 are disposed for registry with switch points 23 as will be hereinafter explained.

The cylinder bushing 30 may be a columnar member including an interior screw keyway 32 keyway which extends from the key hole 31 at one end of the cylinder bushing 30 to the bottom of a burying hole 34. Burying hole 34 is disposed at the other end of the cylinder bushing 30 and allows the screw member 42 of the screw key 40 to enter. There is provided an adequate clearance between the screw keyway 32 and the screw member 42 and as is clearly shown in FIGS. 1 and 2, keyway 32 is formed by a central axial post 320, centrally disposed in bushing 30 by respective transverse members 321. Transverse members 321 are spaced at intervals to accept the spiral screw member 42. A switch block 24 of the cylinder 20 is disposed in burying hole 34. These two elements are fixed by the stop-turning balls 35. A quantity of the stop-turning balls 35 are used in accordance with the intervals between the steel wires of the switch points 23. Stop turning balls 35 are set in a hole 38 in the wall of the burying hole 34 and are fixed by a small screw 37 at a resilient retaining piece 36 on the wall of the cylinder bushing 30. Balls 35 are pushed in by retaining piece 36 to fix cylinder 20 with the stop-turning hole 28 at the switch block 24.

The switch block 24 of the cylinder 20 bears the switch points 23. The switch points 23 may be composed of ten steel wires 231—240 of different diameters, which are aligned up and down along the interior face of the switch block 24 forming a screw thread. This screw thread is an extension of the keyway's screw thread. At the other end of the cylinder 20 there is a top head 21 with two parallel cutting faces 26 and a convex surface 27.

The lock body 10 has a cylinder hole 11, which allows the cylinder 20 and the cylinder bushing 30 to enter in order. All of them can be fixed by inserting a pin 15 through a pin hole 151 formed in lock body 10 to tightly push against the outer face of the cylinder bushing 30.

Two lock hook holes 16 are formed at the other end of the cylinder hole 11; holes 16 are adapted for receiving a lock hook 12. Lock hook 12 includes, disposed in the interior surface thereof, respective cutouts 121. Respective locking ball holes 14 are formed at each sidewall of the bottom of the cylinder hole 11 in communication with the locking hook holes 16 and disposed for registry with cutouts 121. Locking balls 13 are respectively disposed in locking ball holes 14 adapted to be pushed by the convex surface 27 of top head 21 into the cutout 121 of the lock hook 12 from the locking ball holes 14 to effect the locking. When the cutting faces 26 are aligned with the locking ball holes 14, the locking balls 13 will not be pushed. Consequently, the lock hook 12 is released to effect unlocking.

With reference now to FIG. 2, the operation of the screw lock will be explained. FIG. 2 is the assembly front view of this embodiment of the present invention, in which the screw key 40 makes a clockwise turn into the cylinder 20 from the key hole 32 of the cylinder bushing 30. When the screw on the top ring of the screw key 40 meets the screw thread formed by the wires 231–240 of the switch points 23 in the cylinder 20, further rotational entry is arrested. (As shown in FIG. 3, it is an action indicative in view of the top ring screw in contact with the switch points.) However, since there is an considerable clearance between the screw member 42 and the screw keyway 32, the slots 431–440 on the top ring screw can be pushed in forming a convex-concave match with the wires. When the top ring screw is pushed in, it will also push the stop-turning balls 35 out of the stop-turning holes 28 in the switch block 24. Accordingly, upon further rotation of key 40 the slots 431–440 will drive the wires 231–240 to make the entire cylinder 20 turn clockwise 90°. The screw key 40 is devised to become locked after it is pushed in and makes a counter-clockwise 90° urn. At this time, the handle end of the key 40 will be against the key hole 31 so it is prevented from making a counter-clockwise turn. Further, when the cutting faces 26 of the top head 21 are aligned with the locking ball holes 14, the pushing force to the locking ball 13 will be released and the lock hook 12 can be taken out to effect unlocking.

According to the practical example of this invention, FIG. 3 shows that the mechanism of the switch points are composed by ten wires 231–240 of different diameters. These wires are attached to the inner circular face of the switch block 24 and arranged axially along the spindle. The connection lines of their ends form a screw thread which is equal to that formed at the top ring screw 42 of the screw key 40. In other words, the respective lengths (or forward most extent) of the wires vary in accordance with the thread of key 40 to facilitate the turning of screw key 40 into cylinder 20 until registry between wires 231–240 and slots 431–440 is achieved. When screw key 40 has been screwed through the key hole 31 and through the keyway 32 until it is against the switch block 24 of the cylinder 20, the top ring screw 43 will be just under the screw formed by the ends of the wires 231–240 at the switch points 23. The slots 431–440 are, therefore, captured with the wires 231–240 and screw key 40 will be prevented from further rotation but can be pushed in. Sufficient clearance between the screw member 42 of screw key 40 and the keyway 20 of the cylinder 32 is provided to allow key 40 to be pushed in.

In this respect, the slots 431–440 will provide a convex-concave match with the wires 231–240. While the top ring screw is pushed into the switch block 24, the stop-turning balls 35 consequently will be pushed out of stop-turning hole 28 in the circular face of the switch block 24, and the match of the slots 431–440 and the wires 231–240 will drive the whole cylinder to make a clockwise 90° turn to effect unlocking or to make a counter clockwise 90° turn to effect locking.

In the practical example of this invention, locking and unlocking operations are based on the cam function of convex surface 27 and the cutting faces 26 of the top head 21. The positions of the convex surface 27 and the cutting face 26 are in 90° angle. When the cylinder 20 makes a clockwise 90° turn, the cutting faces 26 are just turned to the position of the locking ball holes 14, so the locking ball 13 is not pushed and the lock hook 12 can pulled out from the lock hook holes 16. On the other hand, when a counter clockwise 90° turn is made the convex surface 27 of the top head 21 will push against locking balls 13, forcing them through hole 14 into cutout 121 of the lock hook 12. In this case, the lock hook 12 cannot be pulled out, and it is therefore locked.

Figure 6:
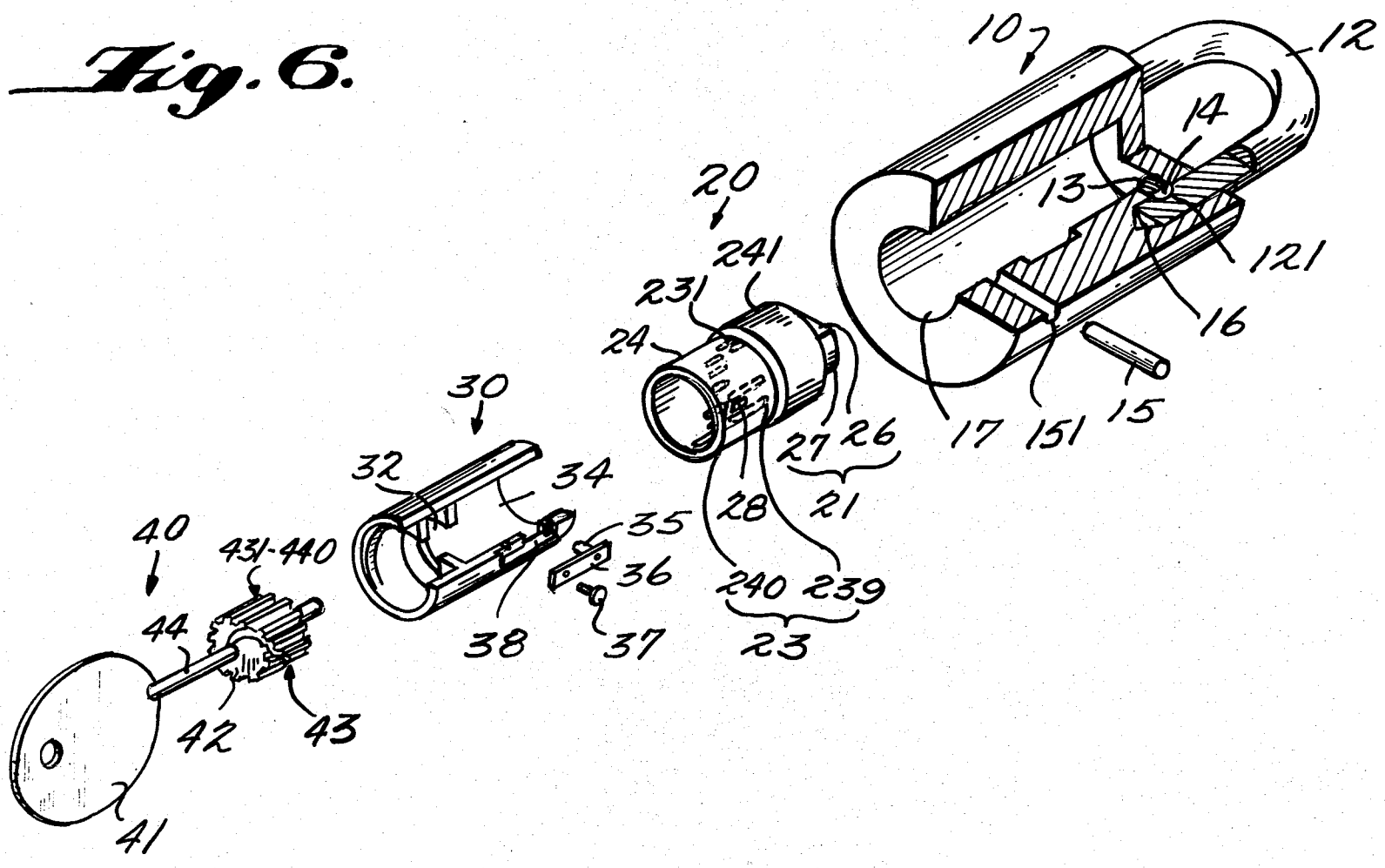
FIG. 6 is an assembly relief map of another embodiment of this invention.

Referring now specifically to FIG. 6, in which another embodiment of the present invention is depicted, the key 40 is a type of spiral key. The key 40 includes a round head 41 which facilitates gripping by the user of the key. Extending from the round head 41, is a gear wheel body having a spiral shank 42 with longitudinal slots 431–440 disposed on the circumference thereof. The width and depth of slots 431–440 are generally equal to the switch points 23 of the cylinder 20 and are arranged for registry with switch points 23, as previously discussed. The switch points 23 are longitudinally disposed in the cylinder 24 and are composed of no more than ten steel wires 231–240 of various diameters.

The cylinder bushing 30 includes a member which defines an interior screw keyway 32. The screw keyway 32 is adapted for accommodating the spiral key 40 and permits the spiral key 40 to be moved through the screw keyway 32 by a turning movement applied thereto. As the key 40 is turned into the keyway 32, a portion of the keyway 32 is mated with the spiral thread 43. In such a manner the key can be advanced through keyway 32 such that the slots 431–440 will mate with the steel wires 231–240 thereby engaging the cylinder 20 and enabling operation of the lock. The remaining operations of this embodiment are identical to that of the embodiment depicted in FIGS. 1 and 2 and described in detail above.

Thus, a screw lock in accordance with the present invention wherein a screw shaped key is turned into a screw adapted keyway in order to open the switch points, provides a measure of safety such that there is virtually no way to destroy or unlock the switch points with foreign articles being placed in switch points of the keyway nor can the mechanism of the switch points be viewed from the outside.

Since the switch points are composed of wires, the wire diameters, intervals and positions can be greatly varied. Additionally, the screw hole diameters and the screw angles can be varied to promote a quantum of safety. In this case, the probability of encountering two locks with equal mechanism is only 1/9,999,999,999, which can, undoubtedly, be considered safe.

All the above mentioned are practical examples for this invention. Thus, any variation, modification or application which is derived from this invention will be deemed to be within the spirit and scope of the appended claims.

I claim:

1. A lock comprising:

a body including a main bore;

a cylinder disposed for selective rotational movement in said bore, said cylinder including a central cylinder bore having respective cylinder switch points disposed therein, said cylinder switch points comprising axially disposed protrusions in the interior of said central cylinder bore;

a bushing secured in said main bore rearwardly adjacent to said cylinder, said bushing, including a keyway aperture defining predetermined spiral parameters; and a spiral shaped key member having at least one spiral turn, configured in accordance with said predetermined parameters, removably received in said cylinder bore by screwing advancement through said bushing, said key member including a respective key switch point means for operating with said cylinder switch points to selectively effect rotation of said cylinder, said key switch point means comprising respective depressions in said spiral shaped key member disposed on the circumference of the spiral turns of said spiral shaped key member to receive said protrusions.

2. The lock of claim 1 wherein said depressions are disposed in the forward most turn of said spiral shaped key member.

3. The lock of claim 1 wherein said cylinder switch points comprise respective wires of predetermined diameters, fixed on the interior surface of said cylinder bore, and said key switch point means comprise respective grooves in said spiral key member for registering with and receiving said wires.

4. The lock of claim 1 further including rotation restraining means, cooperating with said spiral key member, for selectively restraining rotational movement of said cylinder in the absence of said key member.

5. A lock comprising:

a body including a main bore;

a cylinder disposed for selective rotational movement in said bore, said cylinder including a central cylinder bore having respective cylinder switch points disposed therein, said cylinder switch points comprising axially disposed protrusions in the interior of said central cylinder bore;

a bushing secured in said main bore rearwardly adjacent to said cylinder, said bushing, including a keyway aperture defining predetermined spiral parameters;

a spiral shaped key member configured in accordance with said predetermined parameters, removably received in said cylinder bore by screwing advancement through said bushing, said key member including respective key switch point means for operating with said cylinder switch points to selectively effect rotation of said cylinder, said key switch point means comprising respective depressions in said spiral shaped key member disposed to receive said protrusions;

said protrusions having varying axial lengths in accordance with said predetermined spiral parameters and being disposed to prevent further screwing advancement of said key member, whereby said key member is pushed axially forward to receive said protrusions in said depression;

said cylinder including a switch block portion extending rearwardly into said bushing, and including a stop-turning hole in the exterior wall thereof facing the interior wall of said bushing;

said bushing including a stop-member disposed in said stop-member hole;

said bushing further including a stopmember disposed in said stop-member hole, and biased to extend into said cylinder stop-turning hole, to thereby prevent rotational movement of said cylinder;

said stop-turning hole being disposed with respect to said cylinder switch point axial protrusions, such that pushing said spiral key member axially forward brings a portion of said spiral key member into registry with said stop-turning hole, to dislodge said stop-member from said stop-turning hole and allow rotational movement of said cylinder.

* * * * *